US006438348B2

(12) United States Patent
Kobaru et al.

(10) Patent No.: US 6,438,348 B2
(45) Date of Patent: Aug. 20, 2002

(54) FIXING APPARATUS WITH FIRST AND SECOND HEATING ROTATION MEMBERS HAVING A POTENTIAL DIFFERENCE

(75) Inventors: Yasunari Kobaru, Numazu; Takayasu Yuminamochi, Shizuoka-ken; Hiroshi Kataoka, Shizuoka-ken; Takashi Narahara, Shizuoka-ken; Tomoyuki Makihira, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/765,375

(22) Filed: Jan. 22, 2001

(30) Foreign Application Priority Data

Jan. 25, 2000 (JP) ..... 2000-015389
Jan. 18, 2001 (JP) ..... 2001-010261

(51) Int. Cl.[7] ..... G03G 15/20
(52) U.S. Cl. ..... 399/333; 399/324
(58) Field of Search ..... 399/324, 328, 399/327, 330, 331, 333; 217/216, 469, 470; 432/57, 60

(56) References Cited

U.S. PATENT DOCUMENTS 5,153,654 A 10/1992 Yuminamochi et al. ..... 355/277
5,177,549 A 1/1993 Ohtsuka et al. ..... 355/284
5,223,900 A 6/1993 Yuminamochi et al. ..... 355/273
5,481,349 A * 1/1996 Satoh et al. ..... 399/328
5,682,576 A 10/1997 Sakai et al. ..... 399/69
5,904,871 A 5/1999 Sakai et al. ..... 219/216
6,002,106 A 12/1999 Kataoka et al. ..... 219/216

FOREIGN PATENT DOCUMENTS

JP 11-258944 * 9/1999

* cited by examiner

*Primary Examiner*—Joan Pendegrass
(74) *Attorney, Agent, or Firm*—Fitzpatrick, Cella, Harper & Scinto

(57) ABSTRACT

A fixing apparatus has a first rotating member, a first heating device for heating the first rotating member, a second rotating member forming a nip together with the first rotating member, and a second heating device for heating the second rotating member wherein a recording material bearing an unfixed image thereon is nipped and conveyed at the nip in such a manner that the unfixed image is in contact with the first rotating member and is fixed by heating on the recording material. A voltage applying device applies voltage to create potential difference between the first rotating member and the second rotating member, and the second rotating member has a conductive parting layer with a surface resistance of $10^6$ Ω or less on a surface thereof.

4 Claims, 7 Drawing Sheets

FIXING APPARATUS WITH FIRST AND SECOND HEATING ROTATION MEMBERS HAVING A POTENTIAL DIFFERENCE

BACKGROUND OF THE INVENTION

1. Field of the Invention

The present invention relates to a fixing apparatus for use in image forming apparatus such as an electrophotographic printer and a copying machine.

2. Related Background Art

As a fixing apparatus provided for such image forming apparatus, there has been known an apparatus which fixes an unfixed toner image on a transferring material by passing a nip portion a recording medium, that is, a transferring material such as paper having an unfixed image, that is, an unfixed toner image borne thereon while pressurizing and heating the same, the nip portion being constituted by a fixing body that is a thermal fixing means in the form of a hollow roller or of an endless film to be heated from its inside by a first heating means, and a pressurizing body that is an elastic pressurizing roller in press contact with the thermal fixing means.

Recently, in order to prevent offsets of unfixed toner image to the surfaces of the thermal fixing means and the elastic pressurizing roller, many fixing apparatus have adopted a construction in which potential difference is induced between the surfaces of the thermal fixing means and the elastic pressurizing roller in such a direction that presses the unfixed toner image formed on a transferring material against the transferring material.

As a fixing apparatus adopting a thermal roller fixing method which utilizes a pipe-like metal roller as a thermal fixing means, there is, for example, one having the following construction.

Specifically, the construction is such that electrical potential repelling a toner is induced on the surface of a fixing body, that is, a fixing roller by applying a bias having the same polarity as the toner (unfixed toner image) (when using a negative toner, the bias is −100 V to −2000 V) to the core metal of the fixing roller, while a pressurizing body, that is, an elastic pressurizing roller is made to be a moderately resistant roller (surface resistance of $10^7$ Ω to $10^{12}$ Ω) by dispersing a conductive material in its fluororesin tube, as a surface layer, and elastic layer, and the potential difference between the fixing roller and the elastic pressurizing roller is maintained by connecting a diode to the core metal. The reason to select $10^7$ Ω to $10^{12}$ Ω for the surface resistance of the elastic pressurizing roller is that, if the surface resistance is less than $10^7$ Ω, there occurs a problem with pressure resistance of the fluororesin tube and, if the surface resistance is more than $10^{12}$ Ω, the fluororesin tube is negatively charged and there exists no potential difference between the fixing roller and the elastic pressurizing roller, thereby causing offsets.

There is another example of fixing apparatus which is constructed in such a manner that the core metal of the fixing roller is grounded, the surface resistance of the elastic pressurizing roller is made as low as $10^6$ Ω or less, and the potential difference between the fixing roller and the elastic pressurizing roller is maintained by bringing an electrode, such as a brush, to which a bias of low voltage (when using a negative toner, the bias is +100 V to +500 V) is applied into contact with the surface of the pressurizing roller. If the surface resistance of the pressurizing roller is more than $10^6$ Ω, potential difference cannot be induced on the surface of the rollers, thereby causing offsets.

In both former and latter cases, the potential difference between the surfaces of the fixing roller and the pressurizing roller is commonly set in such a manner as not to cause offsets under the conditions of low temperature/low humidity.

Thus, inducing potential difference in such a direction that presses the toner against the transferring material has made it unnecessary to apply a parting agent, such as silicone oil, to the surface of the thermal fixing means or to bring a cleaning member into contact with the thermal fixing means and the pressurizing roller, as having done in the conventional apparatus. This causes no accidents such as oil leaking, and moreover, saves the users from having to replace an old cleaning member with a new one.

In recent years, neutral paper has been used as a transferring material for use in image forming apparatus, taking into account the preservability of paper. And as an additive used for bleaching neutral paper, calcium carbonate ($CaCO_3$) has been often used instead of chlorine, allowing for environmental problems chlorine is likely to cause. Since calcium carbonate ($CaCO_3$) provides a high degree of brightness and is low-priced, in some cases, a transferring material may contain up to 25% of calcium carbonate.

However, the use of the transferring material containing calcium carbonate ($CaCO_3$) (hereinafter referred to as calcium-carbonate-containing paper) in the image forming apparatus provided with the conventional fixing apparatus as described above gives rise to a following problem.

When feeding a sheet of calcium-carbonate-containing paper to the conventional fixing apparatus as described above, the transferring material and the metal and plastic members on the sheet-conveying path rub together, which gives rise to paper dust. Calcium carbonate and calcium-carbonate-containing paper dust are positively charged easily due to the friction against metals and plastics; therefore, when applying a bias to the fixing apparatus so as to prevent offsets of negatively charged toner, calcium-carbonate-containing paper dust is adsorbed on the fixing roller, contrary to the intention.

As a result, in the fixing apparatus which are intended to prevent offsets from occurring by applying a bias having the same polarity as toner to the core metal of the fixing roller, there arises a problem as described below.

The surface potential of the fixing roller on the image printing side is canceled out by the calcium-carbonate-containing paper dust, and the negatively charged toner offsets to the fixing roller. Then the problem of "adhesion of toner to the pressurizing roller" arises in which the offset toner together with the calcium-carbonate-containing paper dust transfer and accumulate little by little on the pressurizing roller at the sheet interval (in state where no paper is at the nip portion in the intervals between printings). Although the amount of the toner transferring to the pressurizing roller is very small, when passing several thousands to tens of thousands of sheets of calcium-carbonate-containing transferring material through the fixing apparatus under the conditions of low temperature/low humidity, the toner grows to become flake-like masses which appear on the rear and front surfaces of the image on the transferring material, thereby impairing the image quality.

Further, when using a moderately resistant tube having surface resistance of $10^7$ Ω to $10^{12}$ Ω as a surface-layer fluororesin tube of the pressurizing roller, the surface resistance increases with the increasing number of the passing sheets and the surface is negatively charged; therefore, the potential difference between the fixing roller and the pressurizing roller disappears, causing offsets. Particularly when using calcium-carbonate-containing paper, since its surface resistance is relatively high, the surface of the pressurizing roller is likely to be charged negatively.

In the fixing apparatus which are intended to prevent offsets from occurring by grounding the core metal of the fixing roller, rendering the surface resistance of the pressurizing roller as low as $10^6$ Ω or less, and applying a bias of low voltage having the polarity opposite to toner to the surface of the pressurizing roller, there arises a problem as described below.

Due to the increase in carbon content of the surface fluororesin layer of the pressurizing roller, the parting tendency of the roller surface deteriorates, and when passing several thousands to tens of thousands of sheets of calcium-carbonate-containing paper through the fixing apparatus under the conditions of low temperature/low humidity, the problem of "adhesion of toner to the pressurizing roller" arises, thereby impairing the image quality.

As described above, if the surface resistance of the pressuring roller is made low by dispersing conductive materials, such as carbon and metal powders, in the surface fluororesin layer of the pressurizing roller, the surface potential is stabilized and offsets are prevented from occurring; however, since the parting tendency of the roller surface is decreased, when passing sheets of calcium-carbonate-containing paper, the problem of "adhesion of toner to the pressurizing roller" arises. These are on the horns of a dilemma. At the present stage, it is difficult to form a conductive parting layer which satisfies both the low-resistance and the satisfactory parting tendency of the surface of the pressurizing roller.

SUMMARY OF THE INVENTION

Accordingly, an object of the present invention is to provide a fixing apparatus which enables a toner to be prevented from adhering to a rotating member having a conductive parting layer on its surface.

Another object of the present invention is to provide a fixing apparatus including a first rotating member, first heating means for heating the first rotating member, a second rotating member for forming a nip together with the first rotating member, voltage applying means for applying voltage to create potential difference between the first rotating member and the second rotating member, and second heating means for heating the second rotating member, in which a recording material with an unfixed image borne thereon is nipped and conveyed at the nip in such a manner as to be allowed to come in contact with the first rotating member, thereby the unfixed image being heated and fixed on the recording material, the second rotating member having a conductive parting layer on its surface.

The other objects of the present invention will become more apparent from the following description.

DETAILED DESCRIPTION OF THE PREFERRED EMBODIMENTS

In the following, the embodiments of the present invention will be described with reference to the accompanying drawings.

(First Embodiment)

A first embodiment of the present invention will be described.

In the first embodiment, the present invention is applied to a laser beam printer which is one example of image forming apparatus.

First, an outline will be given of the body of an image forming apparatus according to this embodiment.

Figure 1:
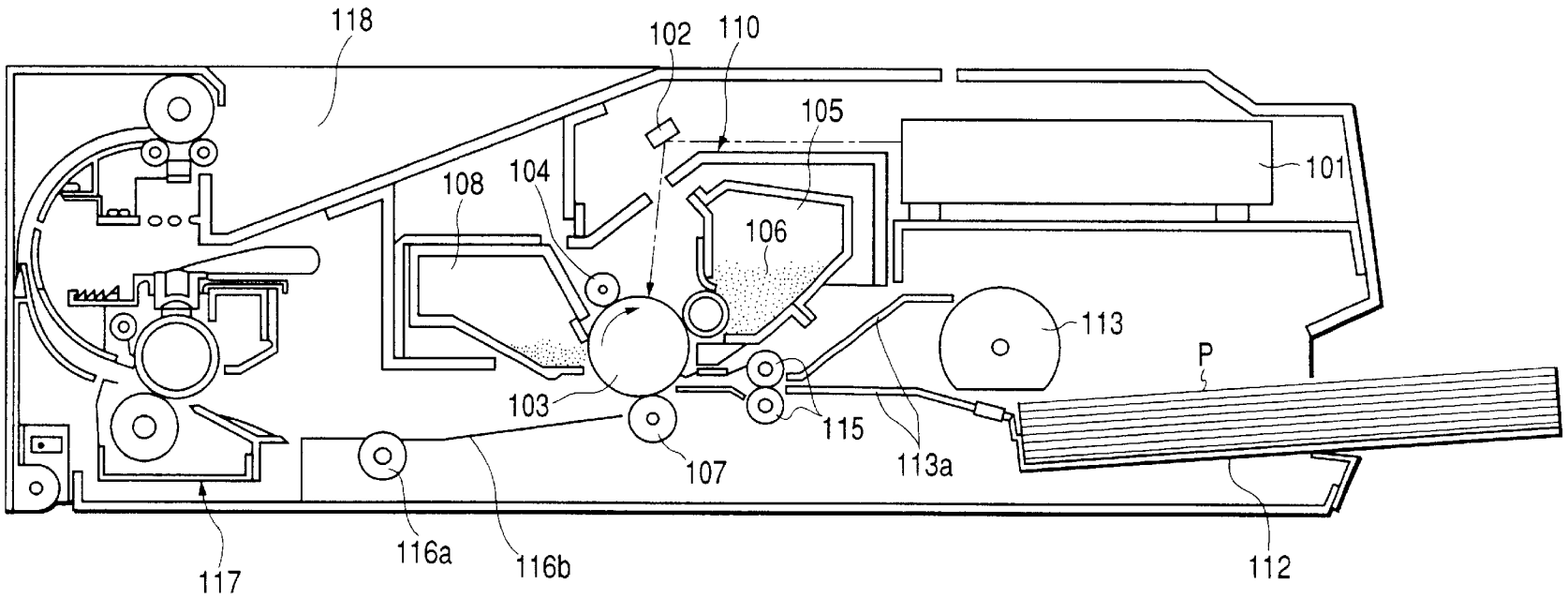
FIG. 1 is a view of an image forming apparatus to which a fixing apparatus in an embodiment of the present invention is applied.

Referring now to FIG. 1, there is shown a schematic view of the construction of the laser beam printer according to this embodiment.

Such a laser beam printer includes a scanner unit 101 with an optical means and a scanning means for respectively irradiating and scanning a laser beam sent out according to image information and a process cartridge 110 with a built-in main image forming means.

The process cartridge 110 has a photosensitive drum 103 as an image bearing member, a roller charging device (electrifier) 104 formed of semi-conducting rubber, a developing apparatus 105 for developing a toner 106 on the photosensitive drum 103, and a cleaner 108 for removing a waste toner from the photosensitive drum 103.

The photosensitive drum 103 within the process cartridge 110 rotates in the direction shown by an arrow and is constructed in such a manner as to have an electrostatic latent image formed on its surface when irradiated with a laser beam sent out from the scanner unit 101 via a mirror 102 after its surface is uniformly charged by the roller electrifier 104.

This electrostatic latent image is visualized as a toner image by the supply of a toner from the developing apparatus 105.

On the other hand, a transferring material P, as a recording material, within a sheet feeding cassette 112 is separated one by one by a sheet feeding roller 113 and a separating pad (not shown in the figure) provided opposite to the sheet feeding roller 113 so as to be fed, and the fed transferring material P is conveyed along upper and lower guides 113*a* to a pair of registration rollers 115. The registration rollers 115 remain at rest until the transferring material P reaches them and, once the tip end of the transferring material P abuts against them, they correct the skew feeding of the same. Then the registration rollers 115 convey the transferring material P to a transferring portion in such a manner as to synchronize the same with the tip of the image formed on the above photosensitive drum 103. In the vicinity of the registration rollers 115, a sheet feeding sensor (not shown in the figure) is installed which enables the detection of the sheet-passing conditions, the presence of jam, and the length of the transferring material.

The transferring material P having been conveyed to the transferring portion in such a manner as above is provided with electric charge having the polarity opposite to the toner by a transferring roller 107, and the toner image formed on the above photosensitive drum 103 is transferred to the above transferring material P. The transferring material P having the toner image transferred thereto is conveyed to a fixing apparatus 117 by a conveying roller 116*a* and a conveying guide 116*b*, the above fixing apparatus 117 melts and sticks the toner image on the transferring material P by applying heat and pressure, so as to form a recording image. The transferring material P having the image fixed thereon is delivered to a discharging tray 118 via conveying rollers selected by a flapper (not shown in the figure). The toner used in this embodiment is a negative toner used in the reversal developing system. The process speed is 100 mm/sec.

Now the outline of the fixing apparatus 117 will be described with reference to FIG. 2.

Figure 2:
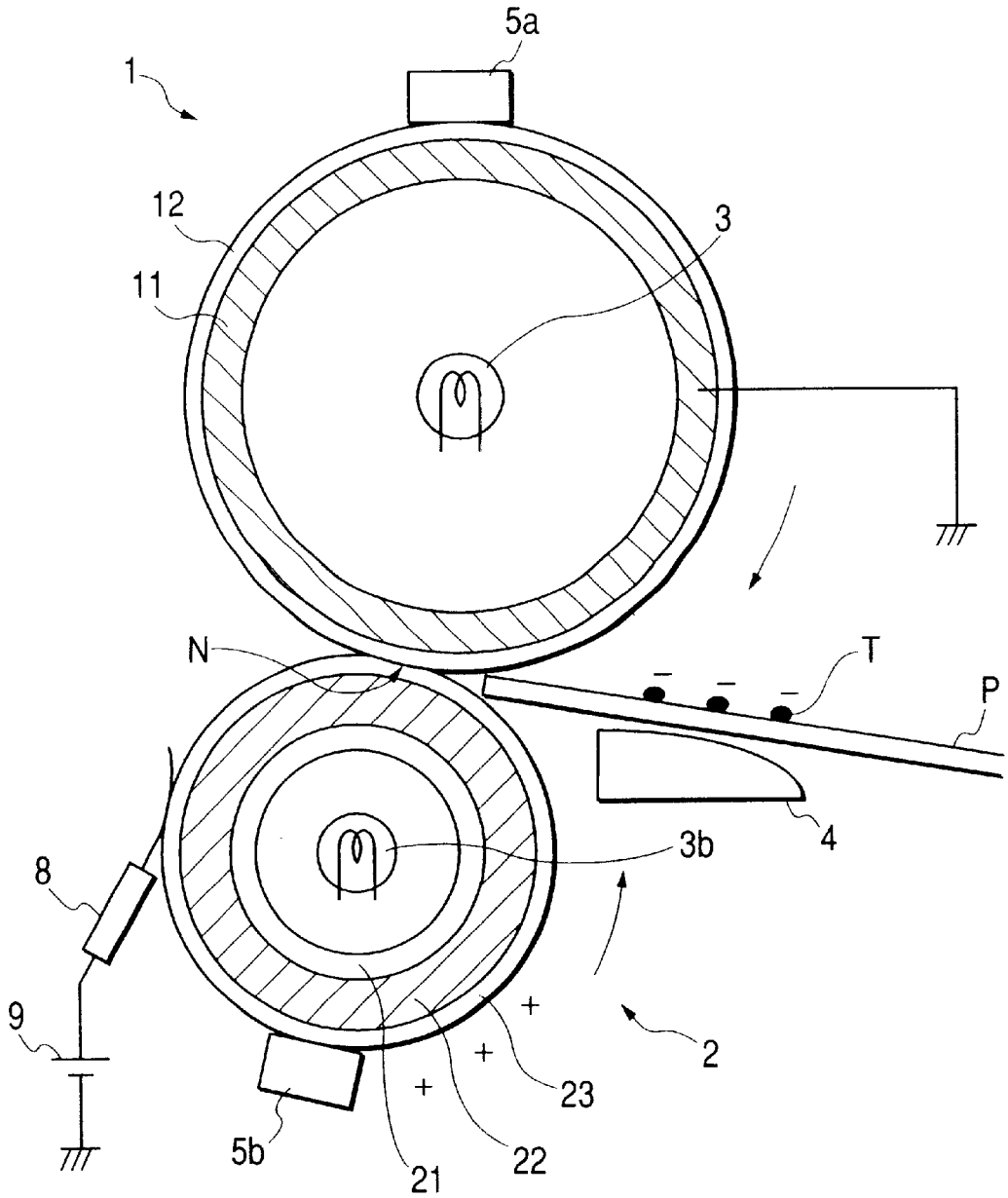
FIG. 2 is a view of a fixing apparatus embodying the present invention.

In FIG. 2, reference numeral 1 denotes a fixing roller, as a fixing body which is a first rotary member, including an aluminum core metal 11 and a fluororesin layer 12 as an electrically insulating parting layer of 50 $\mu$m thickness provided on the periphery thereof. Inside the fixing roller 1, there is provided a heater 3 (600 W), as a halogen heater as well as a first heating means, which heats the fixing roller 1 from its inside. A silicone rubber layer may be provided between the fluororesin layer 12 and the core metal 11, if necessary.

Reference numeral 2 denotes a pressurizing roller, as a pressure body as well as a second rotary member, which is pressed against the fixing roller 1 with a force of 20 kgf (20×9.8=196 N) by a pressure means (not shown in the figure), so as to form a nip portion N (5 mm). The pressurizing roller 2 includes an aluminum core metal 21, a rubber elasticity layer 22 of heat-resistant silicone rubber provided on the periphery thereof, and a electrically conductive fluororesin layer 23, as a surface layer as well as a conductive parting layer, provided on the rubber elasticity layer 22. Inside the pressurizing roller 2, there is provided a heater 3*b* (400 W), as a second heating means, which heats the pressurizing roller 2 from its inside.

Reference numerals 5*a*, 5*b* denote thermistors for detecting the surface temperature of the fixing roller 1 and the pressurizing roller 2, respectively, which are in contact with the surface of the fixing roller 1 and the pressurizing roller 2, respectively, under a predetermined contact pressure and control the on/off of the current flow to the heaters 3, 3*b* (an electric circuit involved in the on/off of the current flow is not shown in the figure) so as to keep the surface temperature of the fixing roller 1 and the pressurizing roller 2 constant, respectively. In a fixing apparatus including a cleaning mechanism, the thermistors 5*a*, 5*b* can be provided in the transferring-material-passing area; however, in a fixing apparatus including no cleaning mechanism, as shown in FIG. 2, they should be provided in an edge portion where no transferring material passes through so as to avoid smudges on the image. However, the thermistor 5*b* in contact with the surface of the pressurizing roller 2 may be provided in the transferring-material-passing area, since it is on the non-printing side.

An unfixed toner image T is fixed on the transferring material P by the application of heat and pressure at the nip portion N. The fixing roller 1 comes in contact with the transferring material P on the side where the unfixed toner image T is borne.

Reference numeral 4 denotes an inlet guide which serves to stably convey the transferring material P having an unfixed toner image formed thereon to the fixing nip portion.

Reference numeral 8 denotes a conductive brush, as a conductive member, which is formed by binding stainless, amorphous, or other fibers in a sheaf for supplying power to the surface of the pressurizing roller. Numeral 9 denotes a power supply. A voltage-applying means has the conductive brush 8, the power supply 9, etc. And the voltage-applying means serves to create an electric potential difference between the fixing roller 1 and the pressurizing roller 2 by which the toner is attracted to the transferring material.

An unfixed image conveyed to the fixing apparatus 117 is fixed by rotating the fixing roller 1 and the pressurizing roller 2 by the use of a driving means (not shown in the figure) while controlling the temperature of the surfaces of the fixing roller 1 and the pressurizing roller 2 under heat to a prescribed temperature.

Now setting of the electric potential in the fixing apparatus 117 will be described.

As methods of setting the electric potential so as to press an unfixed toner image against a sheet, there are two, as described as the related art: (1) applying a bias of the same polarity as the toner to the fixing roller and (2) applying a bias of the polarity opposite to the toner to the pressurizing roller. However, when using a negative toner, the former of the two methods gives rise to a problem of attracting positively charged calcium carbonate and paper dust containing the same to the fixing roller, contrary to expectations, resulting in occurrence of offset and deterioration in parting tendency of the roller surface. Further, since a fluororesin layer or both a fluororesin layer and a thin layer of silicone rubber are provided on the surface of the fixing roller, the capacitance of the surface is small, which is unlikely to induce the electric potential supplied from the power supply to the core metal 11 on the surface.

Accordingly, it is preferable that the core metal 11 of the fixing roller 1 is grounded so as to allow the surface potential to be 0 V and a bias of the polarity opposite to the toner is applied to the pressurizing roller 2.

Now the pressurizing roller 2 will be described.

The core metal 21 is a pipe core metal of 1 mm to 5 mm thickness formed of aluminum, stainless steel and iron and having its inside painted black so that it can efficiently absorb the heat from the heater provided therein. If the thickness is smaller than 1 mm, it will not withstand the pressurizing force of 10 kgf (10×9.8=98 N) to several tens kgf; on the other hand, if the thickness is larger than 5 mm, the heat capacity of the pressurizing roller will become larger, leading to slow temperature increase on the surface thereof.

The rubber elasticity layer 22 is an LTV, HTV silicone rubber of 2 mm to 5 mm thickness. If the thickness is smaller than 2 mm, it will be hard to secure a nip between the pressurizing roller 2 and the fixing roller 1 with the pressurizing force of 10 kgf to several tens kgf; on the other hand, if the thickness is larger than 5 mm, the heat conduction deteriorates extremely.

In this embodiment, an aluminum core metal of 2 mm thickness was covered with HTV silicone rubber of 3 mm thickness.

The fluororesin layer 23 may be formed in such a manner as to coat the surface of the pressurizing roller 2 with a resin consisting of fluororesin, such as PFA, FEP and PTFE, and carbon, as a conductive material, dispersed in the fluororesin or in such a manner as to cover the same with the same resin as above formed into a tube. In terms of uniformity of the carbon dispersion and durability of the pressurizing roller, however, the resin in the form of a tube is preferably used. Particularly when the pressurizing force is large and separating claws are brought into contact with the pressurizing roller, the resin in the form of a tube is preferable because of its durability. Preferably, the fluororesin tube is a conductive tube which has carbon uniformly dispersed therein and of which surface resistance is $10^6$ Ω or less, preferably $10^5$ Ω or less. The reasons are as follows: if the surface resistance is $10^6$ Ω or less, a bias to be applied is induced even by the power supply from the surface of the pressurizing roller as shown in FIG. 2; however, if surface resistance is $10^7$ Ω or more, a bias is not induced on the surface of the pressurizing roller, thereby a potential difference cannot be maintained between the pressurizing roller and the fixing roller, resulting in occurrence of an offset.

In this embodiment of the present invention, a conductive PFA tube was used which was prepared by allowing a PFA resin to contain 15% by weight of carbon so as to have surface resistance of $10^5$ Ω.

A pressurizing roller having Asker-C hardness of 50° to 70° can be obtained by bonding the core metal 21 and the rubber elasticity layer 22, the rubber elasticity layer 22 and the conductive fluororesin layer 23, with primer, respectively.

The process of producing the pressurizing roller 2 may be, for example, such that first the core metal 21, to which primer has been applied, is set in a die previously made to fit to the outer diameter of the core metal, second silicone rubber is injected thereinto, followed by vulcanization and grinding, and finally the core metal with the silicone rubber is covered with the conductive PFA tube by the use of primer. Alternatively, the pressurizing roller 2 may be formed integrally by previously setting the core metal 21 and the conductive PFA tube in a die, then injecting silicone rubber between the core metal 21 and the conductive PFA tube, followed by vulcanization and bonding.

"Adhesion of toner to the pressurizing roller" due to the use of sheets of paper containing calcium carbonate ($CaCO_3$) can be prevented by heating the pressurizing roller 2 with the heater **3*b* provided therein during printing, even when using a conductive PFA tube poor in parting tendency. The reason is that heating the pressurizing roller 2 from its inside allows the viscosity of the toner transferring to the pressurizing roller 2 to decrease, and at the same time, allows the wax contained in the toner to exhibit its parting effect at the interface with the pressurizing roller 2. Thus the toner transferring to the pressurizing roller 2 can be cleaned with the sheet subsequently conveyed before it accumulates. This will not impair the quality of the image because the amount of the toner transferring to the pressurizing roller 2** is very small and it is invisible in the fixed image.

Offset images and "adhesion of toner to the pressurizing roller" were evaluated with the fixing apparatus 117 by continuously passing sheets of paper containing 15% by weight of calcium carbonate ($CaCO_3$) though the apparatus under the conditions of 15° C./10% RH.

TABLE 1

| Surface Resistance of | Surface Potential of Pressurizing roller before/after passing Sheets of Paper (V) | | Offset | |
|---|---|---|---|---|
| Pressurizing roller (Ω) | Initially | After 5000 Sheets of Paper Passing | Initially | After 5000 Sheets of Paper Passing |
| $10^{12}$ | 0 | −500 | B | C |
| $10^7$ | +600 | 0 | A | B |
| $10^6$ | +1000 | +1000 | A | A |
| $10^5$ | +1000 | +1000 | A | A |

C: Clearly Visible
B: Slightly Visible
A: Invisible

Table 1 shows the surface potential of the pressurizing roller before/after passing 5000 sheets of calcium-carbonate-containing paper through the fixing apparatus and the state of offset occurrence measured using four types of pressurizing rollers different in surface resistance.

For the rollers of which surface resistances are $10^{12}$ Ω and $10^7$ Ω, no potential was induced on the surface and clear offsets occurred after passing sheets of calcium-carbonate-containing paper through the fixing apparatus. On the other hand, for the rollers of which surface resistances are $10^6$ Ω or less, the surface potential was kept constant even after passing sheets of calcium-carbonate-containing paper through the apparatus and offsets were invisible.

TABLE 2

| Turn-On-Duty of Heater on Pressurizing roller Side (%) | Temperature of Pressurizing roller (° C.) | Number of Sheets having passed through Fixing Apparatus before Occurrence of Toner Adhesion to Pressurizing roller | Transfer of Toner to Paper |
|---|---|---|---|
| 0 (Not turned on) | 80 | 2500 Sheets of Paper | Occurred after 5000 Sheets of Paper had passed |
| 20 | 90 | 20000 Sheets of Paper | Not occurred before 100000 Sheets of Paper had passed |
| 50 | 110 | Not occurred before 100000 Sheets of Paper had passed | Not occurred before 100000 Sheets of Paper had passed |
| 70 | 120 | Not occurred before 100000 Sheets of Paper had passed | Not occurred before 100000 Sheets of Paper had passed |

Table 2 shows the state of toner adhesion to the pressurizing roller 2 when using the pressurizing roller having surface resistance of $10^5$ Ω, as described in this embodiment, and continuously passing sheets of calcium-carbonate-containing paper through the fixing apparatus while changing the set temperature of the thermistor 5*b* in contact with the pressurizing roller 2. The terms "turn-on-duty (%) of the heater for heating the pressurizing roller (hereinafter referred to as heater on pressurizing roller side)" means that, when the duty is 0%, the heater on the pressurizing roller side is not turned on, and when 100%, the heater on the pressurizing roller side is fully turned on. The terms "temperature of pressurizing roller" means the surface temperature of the pressurizing roller in the sheet-passing area after 500 successive sheets of paper have passed therethrough.

As seen from Table 2, when the heater 3*b* inside the pressurizing roller 2 was not turned on, toner started to adhere to the pressurizing roller 2 on 2500 sheets of paper having passed through the fixing apparatus and flaky masses of toner were produced on the paper on 5000 sheets of paper having passed through the same. On the other hand, when the heater 3*b* inside the pressurizing roller was turned on, even if the turn-on-duty was 20%, no image was produced which lowered the image quality. The heater inside the pressurizing roller may be turned on when the apparatus is standing by; however, in order to ensure the cleaning by sheets of paper, the heater should be turned on during printing so as to enhance the plasticity and parting effects of toner. It goes without saying that this also improves the tendency of toner to fix on paper.

FIG. 2 shows the case where power is supplied to the surface of the pressurizing roller; however, the method of power supply is not limited to the case. For example, the fixing apparatus may be constructed in such a manner as to use conductive silicone rubber having a volume resistivity of $10^3$ Ω·cm to $10^5$ Ω·cm as the rubber elasticity layer 22 and provide a contact on the core metal so as to apply a bias therefrom.

(Second Embodiment)

Now a second embodiment of the present invention will be described. In the second embodiment, the same constituents as those of the first embodiment shall be denoted by the same reference numerals and their descriptions shall be omitted.

This embodiment will be described in detail taking the case where the present invention is applied to a high speed laser beam printer having a processing speed of 200 mm/s and capable of outputting sheets of paper up to A3 size, with reference to FIG. 3.

In image forming apparatus utilizing commercial power supply, the power limit usable for a heater is about 1200 W. For the high speed laser beam printers such as this embodiment, since the power consumption by paper necessarily increases, the power required to heat the fixing roller increases, thereby leading to lack of dump power for heating the pressurizing roller (decrease in the maximum turn-on-duty). Further, due to the high speed, the temperature decrease on the surface of the pressurizing roller is significant, which is likely to cause the problem of "adhesion of toner to the pressurizing roller" under the conditions of low temperature/low humidity. This embodiment is characterized by heating the pressurizing roller in such a manner as to divide the heater inside the fixing roller into two and minimize the heating of the fixing roller by turning on/off the two heaters according to the paper size.

Figure 3:
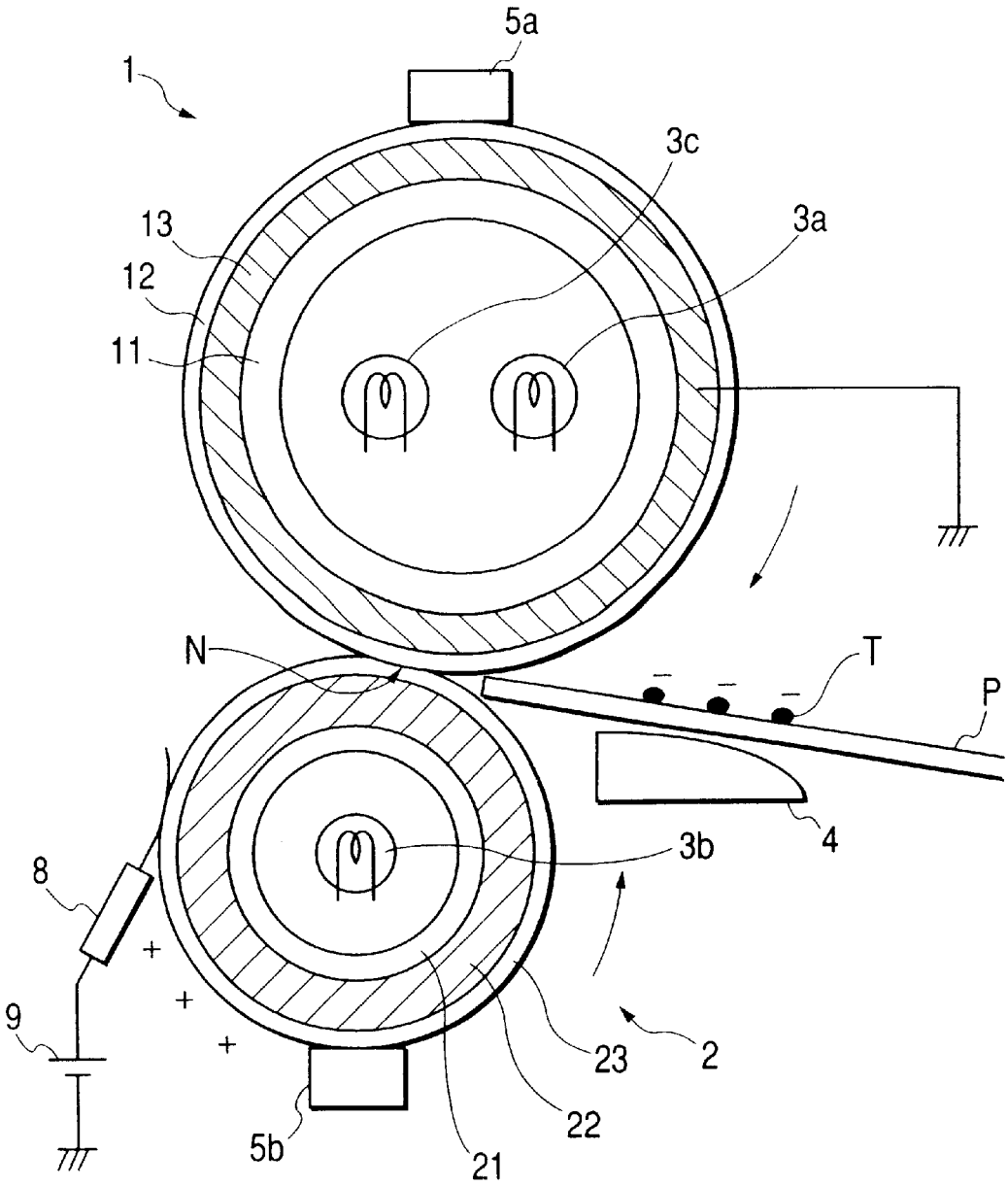
FIG. 3 is a view of a fixing apparatus in the other embodiment of the present invention.
Figure 4:
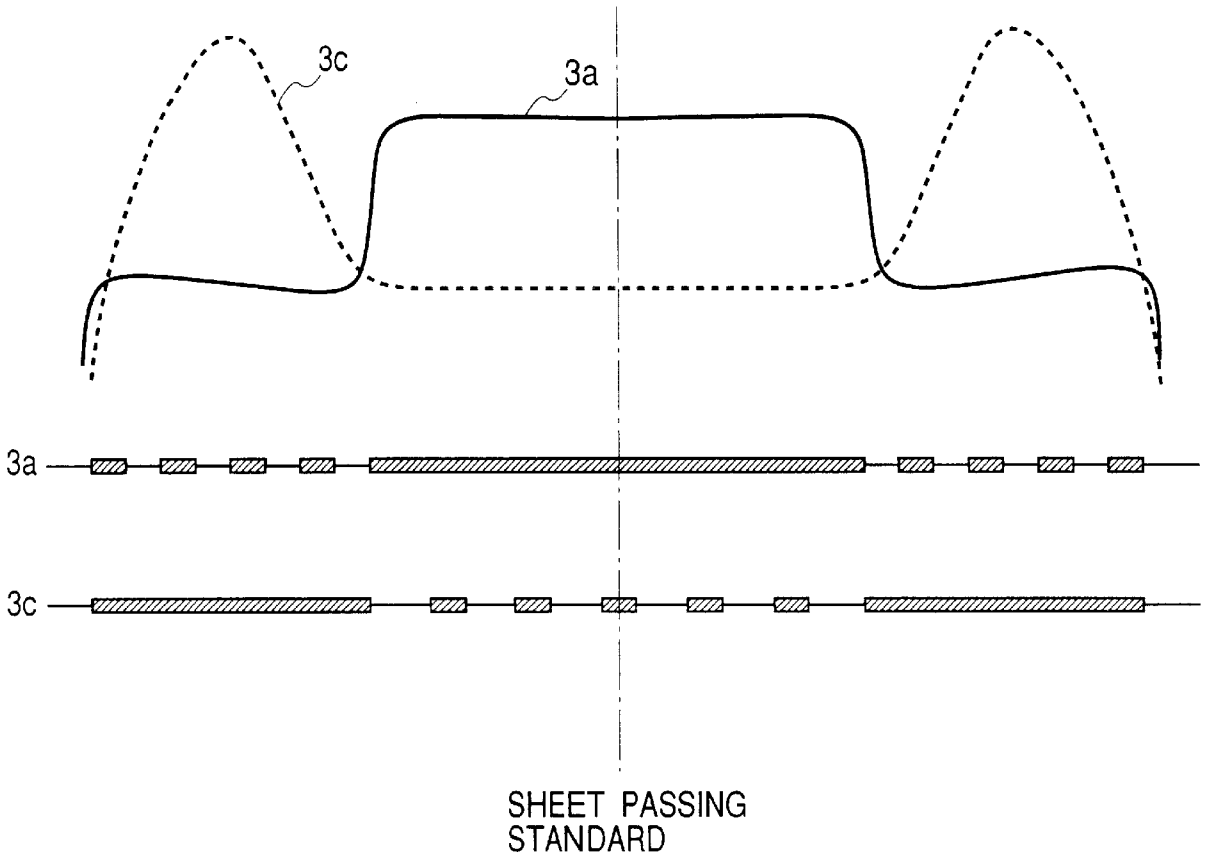
FIG. 4 is a graphical representation illustrating the heater light distribution of the fixing apparatus shown in FIG. 3.

In FIG. 3, as a fixing roller 1 used is a roller with an outer diameter of 45 mm (ϕ45) which consists of an aluminum core metal 11 of 2 mm thickness, an LTV silicone rubber layer 13 of 300 μm thickness provided on the periphery of the core metal 11, and a fluororesin layer (electrically insulating parting layer) 12, which is a PFA resin tube, of 30 μm thickness covering the LTV silicone rubber layer 13. Inside the fixing roller 1, provided are two halogen heaters as first heating means for heating the fixing body: a main heater 3*a* (600 W) for heating mainly the axially central portion of the roller and a sub-heater 3*c* (400 W) for heating mainly the axially end portions of the roller, as shown in FIG. 4. And the temperature of the two heaters are regulated to 190° C. with a thermistor 5*a* arranged on the end portion of the roller. Since the silicone rubber thin layer 13, which is an electrically insulating layer, is formed under the fluororesin layer 12, even when using such paper as has a rough surface, toner shows a satisfactory tendency to fix thereon. The core metal 11 is grounded.

As a pressurizing roller 2 used is a roller with an outer diameter of 30 mm (ϕ30) and a hardness of 60° which consists of an aluminum core 21 metal of 3 mm thickness, a rubber elasticity layer 22 of silicone rubber of 4 mm thickness provided on the periphery of the core metal 21, and a conductive fluororesin layer 23, which is a conductive PFA tube of 50 μm thickness, covering the rubber elasticity layer 22.

The conductive fluororesin layer 23 of the pressurizing roller 2 was formed by allowing a PFA resin to contain 15% by weight of carbon so as to have surface resistance of $10^5$ Ω. Inside the pressurizing roller 2, a heater 3*b* (400 W) of which heat distribution is almost flat in the axial direction of the pressurizing roller 2 was provided so as to heat the pressurizing roller to a target temperature of 120° C. with the aid of the thermistor which is in contact with the roller in the sheet-passing area and prevent the temperature from decreasing. The fixing roller 1 and the pressurizing roller 2 were constructed in such a manner as to give a nip of 6 mm when pressing the pressurizing roller 2 against the fixing roller 1 with a pressurizing force of 30 kgf (30×9.8=294 N).

An amorphous conductive brush 8 is brought into contact with the conductive fluororesin layer 23 of the pressurizing roller 2 in the non-sheet-passing area so as to apply a direct current bias of +1 kV thereto from a power supply 9. Since the fixing roller 1 has the silicone rubber thin layer 13 formed under its fluororesin layer 12, even if a hole is made in the fluororesin layer 12, the bias will not leak. Thus, power can be supplied at 0 V potential on the surface of the fixing roller 1 and at +1 kV potential on the surface of the pressurizing roller 2 in a stable manner.

Figure 5:
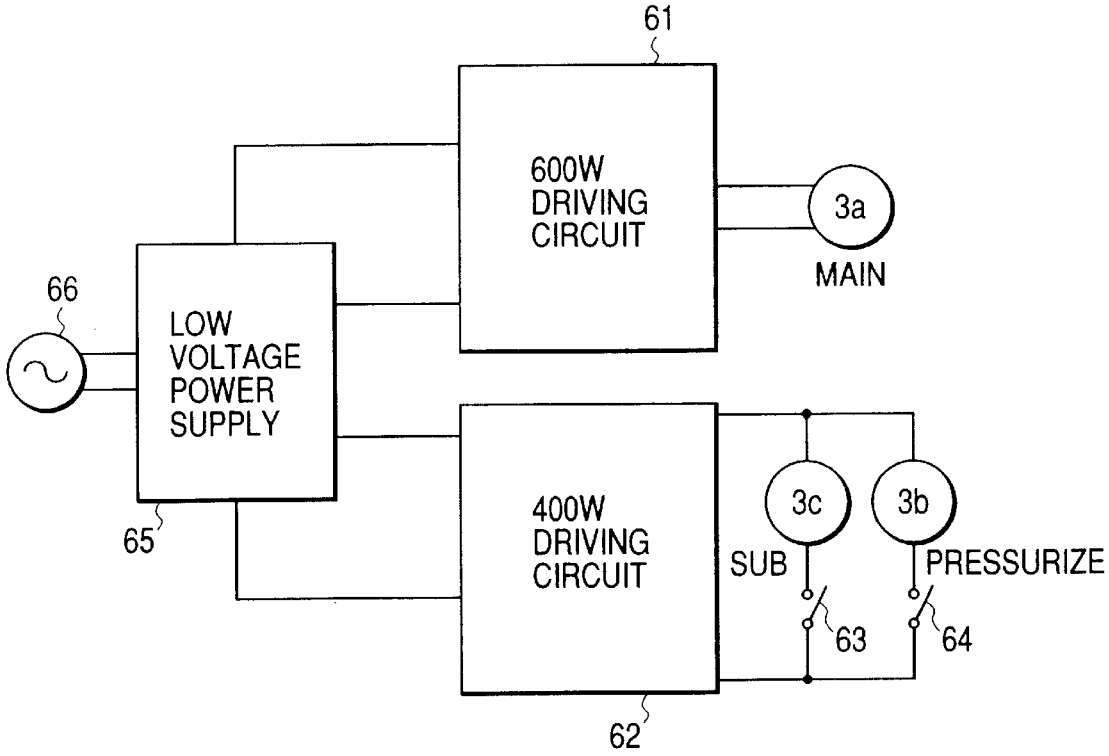
FIG. 5 is a block diagram illustrating the heater driving circuits of the fixing apparatus shown in FIG. 3.

Current is applied to three halogen heaters, as heating sources, by two independent driving circuits: a driving circuit 61 for driving a main heater 3*a* and a driving circuit 62 for driving a sub-heater 3*c* and a heater 3*b* as shown in FIG. 5. To the sub-heater 3*c* and the heater 3*b*, switching elements 63 and 64 are connected, respectively, as shown in FIG. 5, so as to regulate the temperature by selectively shifting from the sub-heater 3*c* to the heater 3*b*. In FIG. 5, reference numeral 65 denotes a low voltage power supply for supplying 90 V to 120 V (or 200 V to 230 V) alternating voltage to the driving circuits 61, 62 and numeral 66 a plug socket.

Figure 6:
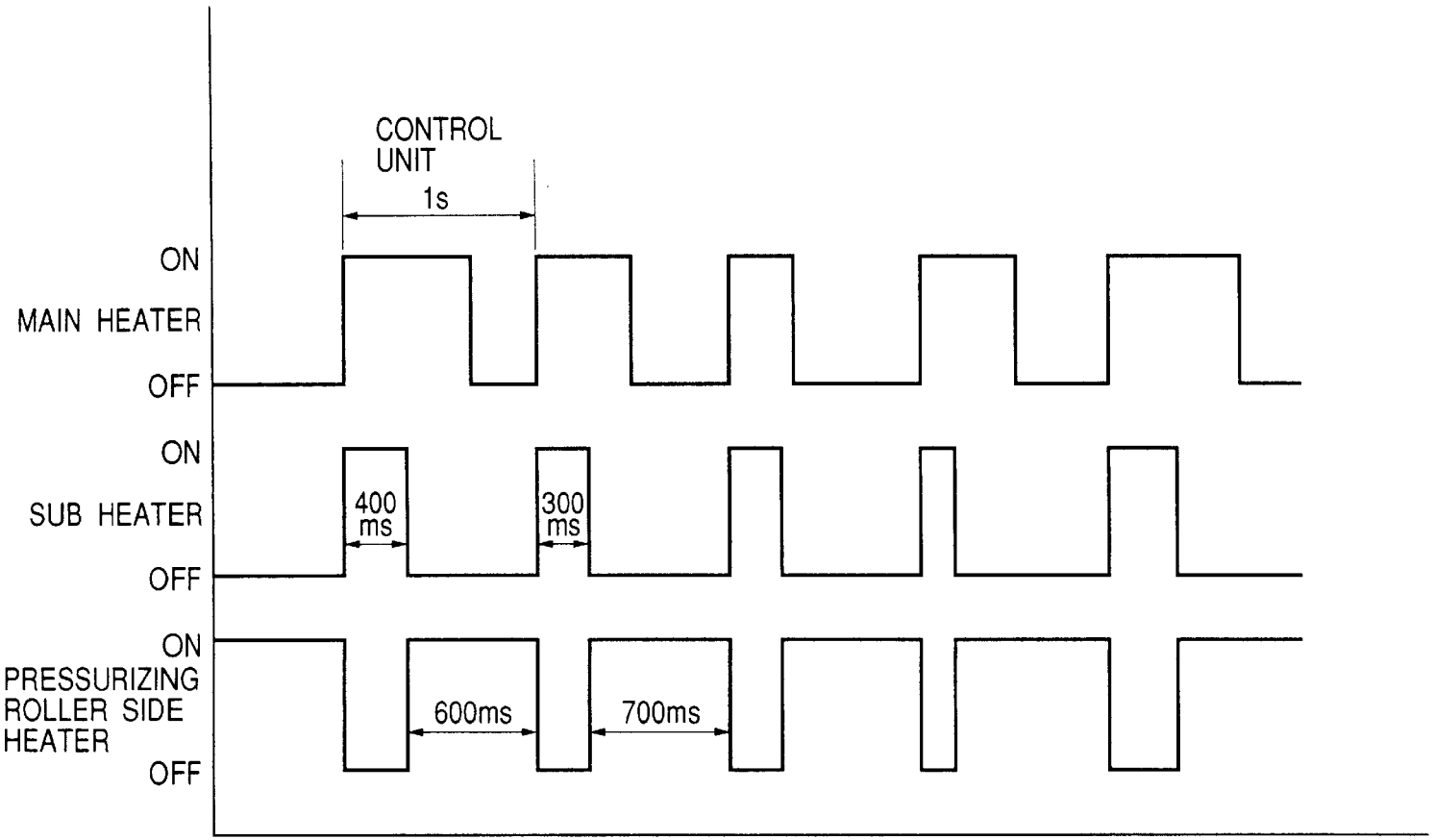
FIG. 6 is a diagram illustrating the heater control of the fixing apparatus shown in FIG. 3.

FIG. 6 shows on/off control of each heater when doing continuous printing on sheets of paper of A4 size in the horizontal position.

The main- and sub-heaters for heating the fixing roller are controlled in such a manner as to keep constant the temperature distribution in the longitudinal direction of the fixing roller 1 by selecting 50% for the turn-on-duty of both the main and sub-heaters within the control unit (1 second in FIG. 6) and keep the temperature of the fixing roller 1 190° C. by changing the turn-on-duty within the control unit referring to the temperature detected by the thermistor.

On the other hand, the heater 3*b* for heating the pressurizing roller 2 is controlled in such a manner that, when the sub-heater 3*c* is in an off condition, it is turned on if the temperature detected by the thermistor is lower than the targeted temperature and it is turned off if the temperature detected by the thermistor is the targeted temperature or higher.

The reason that the current is not applied alternately to two heaters within the fixing roller by one driving circuit, but applied alternately to one heater within the fixing roller and the heater within the pressurizing roller is that doing this makes it possible to avoid power loss during the time to switch the switching element 63 and 64.

Offset images and "adhesion of toner to the pressurizing roller" were evaluated with this fixing apparatus by continuously passing sheets of paper containing 15% by weight of calcium carbonate ($CaCO_3$) though the apparatus under the conditions of 15° C./10% RH. As a result, the offset was satisfactory even after 100,000 sheets of paper passing and "adhesion of toner to the pressurizing roller" did not occur. The turn-on-duty of the heater on the pressurizing roller side was 30% at that time. The maximum turn-on-duties of the heater on the pressurizing roller side for various paper sizes are shown in Table 3, comparing the case where a single 1000 W heater was used within the fixing roller.

TABLE 3

| | Single Heater (1000 W) on Fixing Roller | | Two Heaters (600 W/400 W) on Fixing Roller | |
|---|---|---|---|---|
| Paper Size | Maximum Turn-on-duty of 400 W Heater on Pressurizing Roller Side (%) | Temperature of Pressurizing Roller (° C.) | Maximum Turn-on-duty of 400 W Heater on Pressurizing Roller Side (%) | Temperature of Pressurizing Roller (° C.) |
| A4 size in the horizontal position | 20 | 100 | 30 | 110 |
| B4 | 20 | 100 | 40 | 115 |
| A4 size in the vertical position | 25 | 110 | 50 | 120 |

Table 3 shows that dividing the single heater within the fixing roller into two enables the increase in the maximum turn-on-duty of the heater on the pressurizing roller, and hence the increase in the heat quantity for heating the pressurizing roller, electric power can thereby be effectively distributed to the pressurizing roller side as compared with the first embodiment. Particularly when passing small size sheets of paper through the fixing apparatus, the turn-on-duty of the sub-heater 3*c*, which heats both ends of the fixing roller, can be decreased, accordingly, the pressurizing roller can be fully heated.

(Third Embodiment)

Now a third embodiment of the present invention will be described. In the third embodiment, the same constituents as those of the first embodiment shall be denoted by the same reference numerals and their descriptions shall be omitted.

This embodiment will be described taking the case where the present invention is applied to a laser beam printer which utilizes a fixing film and has a processing speed of 100 mm/s.

Figure 7:
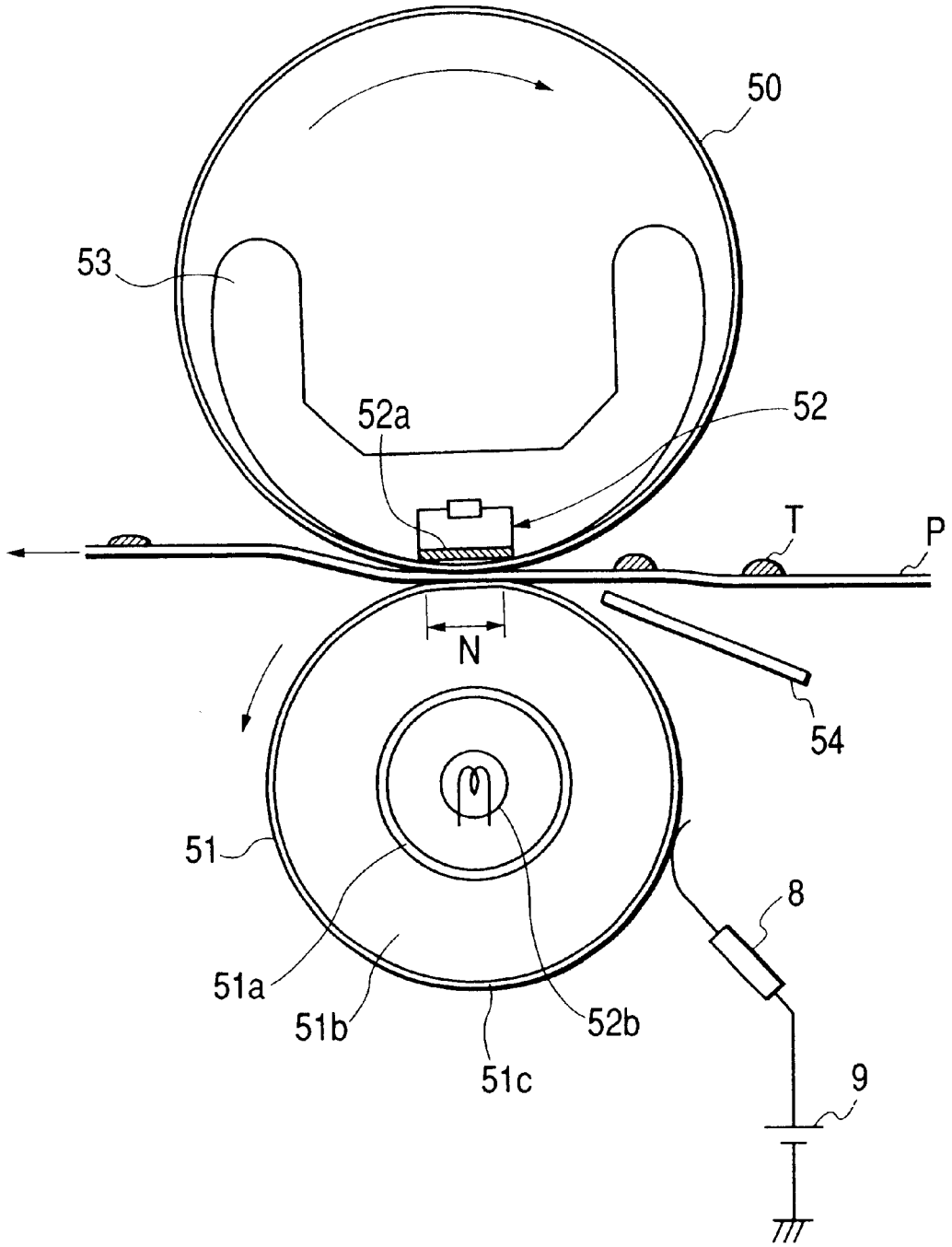
FIG. 7 is a view of a fixing apparatus in the other embodiment of the present invention.

FIG. 7 shows the outline of the fixing apparatus according to this embodiment.

In FIG. 7, reference numeral 50 denotes a heat-resistant film (fixing film) in the form of an endless belt which covers a semicircular film guide member (stay) 53 in such a manner as to have an excess of periphery length actually required to cover the same. The fixing film 50 has a thickness of 100 $\mu$m or less, preferably of 20 to 60 $\mu$m, to reduce the heat capacity for enabling enhanced quick start, and is a single layer film formed of polyimide, polyamide, PEEK or PES which is excellent in heat resistance, strength and durability, or a composite layer film formed by coating the above single layer film with a parting layer of PTFE, PFA or FEP.

Reference numeral 51 denotes a pressurizing roller, as a pressurizing body, with an outer diameter of 25 mm ($\phi$25) which consists of a core metal 51*a* of iron, aluminum or the like, a rubber elasticity layer 51*b* of silicone rubber (3 mm thick) provided on the periphery of the core metal 51*a*, and a conductive fluororesin layer 51*c*, which is a conductive PFA tube with a surface resistance of $10^5$ Ω, covering the rubber elasticity layer 51*b*. The pressurizing roller is rotated by a driving means (not shown in the figure). Inside the pressurizing roller provided is a heating element 52*b*, which is a 200 W halogen heater, as a second heating means to heat the pressurizing roller during printing.

Reference numeral 54 denotes a guide member for guiding a transferring material P into a nip portion N smoothly.

In FIG. 7, the fixing film 50 is rotated with the rotation of the pressurizing roller 51 at a fixed speed in the direction shown by an arrow while being in close touch with the surface of the heating element 52 and sliding on the same. The fixed speed is almost the same as the speed of conveying the transferring material P with an unfixed toner image T borne thereon.

The heating element 52 includes a current-application-type heat generating element 52*a*, as a heat source, which generates heat when being supplied with electric power, and the nip portion is heated with the heat generated by the power supplying type heat generating element 52*a*.

In the sheet-passing area on the surface including the current-application-type heat generating element 52*a* of the heating element 52, provided is a thermistor (not shown in the figure) for detecting the temperature of the heating element 52.

The transferring material P having an unfixed toner image T borne thereon is conveyed to the nip portion N, where it closely touches with the fixing film, and passes therethrough.

Reference numeral 8 denotes an amorphous brush for supplying electric power at +300 V to the surface of the pressurizing roller.

In fixing apparatus adopting this method, it has been difficult to apply a bias voltage to the fixing film 50 because the power supplying type heat generating element 52*a* and the fixing film 50 are adjacent to each other. However, in this embodiment, since electric power is supplied from the surface of the pressurizing roller, the potential difference between the fixing film and the pressurizing roller can be set stably, thereby preventing offsets from occurring.

Generally fixing apparatus have been constructed in such a manner as not to allow a cleaning member to come in contact with the surface of the fixing film, because it is structurally difficult to clean the surface of the fixing film. Furthermore, in terms of the construction, it is impossible to apply a considerably large pressurizing force to fixing apparatus; accordingly, a sharp melt toner has been used of which advantage lies in fixing tendency. However, this has been likely to cause "adhesion of toner to the pressurizing roller".

In this embodiment, on starting printing and starting rotating the pressurizing roller, electric current is applied to the heating elements 52, 52*b*, so as to heat the nip portion N as well as the pressurizing roller. The current application to the heating element 52*b* may be controlled while predicting the surface temperature of the pressurizing roller by detecting the temperature of the same before printing with the thermistor provided on the heating element 52.

When continuously passing sheets of paper containing 15% by weight of calcium carbonate ($CaCO_3$) through the conventional fixing apparatus under the conditions of low temperature/low humidity, "adhesion of toner to the pressurizing roller" has occurred after 2500 sheets of paper passing; however, in the fixing apparatus of this embodiment in which the potential of the pressurizing roller is stabilized and heating is performed from its inside, "adhesion of toner to the pressurizing roller" has never occurred.

Further, since the set temperature of the pressurizing roller can be higher than that of the conventional apparatus, rise time and first print time can be shortened, thereby increasing quick start tendency which is one of the characteristics of this fixing apparatus.

As described above, according to the invention of the present application, the surface potential of the pressurizing body is stabilized by properly setting the surface resistance of the pressurizing body and the releasability of the pressurizing body from an unfixed image is improved by allowing a second heating means to heat the pressurizing body. Thus, when passing recording media, such as paper containing calcium carbonate, between the fixing body and the pressurizing body, the accumulation of toner and the like on the pressurizing body can be prevented, thereby stable image quality can be obtained and offsets of unfixed image on the above recording media to the fixing body and the pressurizing body can be prevented.

While the present invention has been described in terms of its preferred embodiments, those embodiments are not intended to limit the present invention. It should be understood that various changes and modifications can be made in the present invention without departing the spirit and scope thereof.

What is claimed is:

1. A fixing apparatus, comprising a first rotating member;

first heating means for heating said first rotating member;

a second rotating member for forming a nip together with said first rotating member;

wherein a recording material bearing an unfixed image thereon is nipped and conveyed at said nip in such a manner that the unfixed image is in contact with said first rotating member, and the unfixed image is fixed by heating on the recording material, voltage applying means for applying voltage to create potential difference between said first rotating member and said second rotating member; and second heating means for heating said second rotating member, wherein said second rotating member has a conductive parting layer on a surface thereof, and wherein said conductive parting layer of said rotating member has a surface resistance of $10^6$ Ω or less.

2. A fixing apparatus according to claim 1, wherein said voltage applying means applies a voltage to the surface of said second rotating member.

3. A fixing apparatus according to claim 1, wherein said conductive parting layer of said second rotating member is a fluororesin layer containing a conductive agent.

4. A fixing apparatus according to claim 1, wherein said second rotating member has an elastic layer inside said conductive parting layer.

* * * * *

UNITED STATES PATENT AND TRADEMARK OFFICE

CERTIFICATE OF CORRECTION

PATENT NO. : 6,438,348 B2
DATED : August 20, 2002
INVENTOR(S) : Yasunari Kobaru et al.

It is certified that error appears in the above-identified patent and that said Letters Patent is hereby corrected as shown below:

Column 1,
Line 15, “portion” should read -- portion on --.

Column 6,
Line 54, “as” should read -- in --.

Column 10,
Line 44, “as has” should read -- having --.

Column 11,
Line 54, “to” (2nd occurrence) should read -- of --.
Line 55, “switch” should read -- switching --, and “element” should read -- elements --.

Column 13,
Line 29, “with” should be deleted.

Column 14,
Line 31, “departing” should read -- departing from --.

Signed and Sealed this

Tenth Day of December, 2002

JAMES E. ROGAN
*Director of the United States Patent and Trademark Office*